US007931274B2

(12) United States Patent
Krucinski

(10) Patent No.: US 7,931,274 B2
(45) Date of Patent: Apr. 26, 2011

(54) HYBRID CONTROL OF SHEET TRANSPORT MODULES

(75) Inventor: Martin Krucinski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 14 days.

(21) Appl. No.: 12/475,105

(22) Filed: May 29, 2009

(65) Prior Publication Data

US 2010/0301548 A1 Dec. 2, 2010

(51) Int. Cl.
*B65H 5/00* (2006.01)
*B65H 5/34* (2006.01)

(52) U.S. Cl. ..... 271/264; 271/270

(58) Field of Classification Search ..... 271/264, 271/270; 399/16; 347/104
See application file for complete search history.

(56) References Cited

U.S. PATENT DOCUMENTS

| | | | | |
|---|---|---|---|---|
| 3,991,992 | A | 11/1976 | Randall et al. | |
| 4,687,925 | A | 8/1987 | Huggins | |
| 5,120,977 | A | 6/1992 | Dragon et al. | |
| 5,150,115 | A | 9/1992 | deJong et al. | |
| 5,241,525 | A | 8/1993 | Taylor | |
| 5,836,580 | A | 11/1998 | Hansen et al. | |
| 5,838,338 | A | 11/1998 | Olson | |
| 6,032,004 | A | 2/2000 | Mirabella, Jr. et al. | |
| 6,400,913 | B1 | 6/2002 | deJong et al. | |
| 7,305,200 | B2 | 12/2007 | Hoffman et al. | |
| 7,457,557 | B2 | 11/2008 | Roof et al. | |
| 7,673,876 | B1 * | 3/2010 | DeGruchy | 271/264 |
| 2003/0108369 | A1 | 6/2003 | Kuo et al. | |
| 2004/0065994 | A1 | 4/2004 | Halvonik et al. | |
| 2005/0074267 | A1 | 4/2005 | Demchock et al. | |
| 2005/0156374 | A1 | 7/2005 | Siegel et al. | |
| 2006/0039729 | A1 * | 2/2006 | Mandel et al. | 399/381 |
| 2006/0222378 | A1 * | 10/2006 | Julien | 399/2 |
| 2007/0222142 | A1 * | 9/2007 | Owen | 271/256 |
| 2008/0012214 | A1 | 1/2008 | Elliot | |
| 2008/0012215 | A1 | 1/2008 | Elliot | |
| 2008/0136092 | A1 | 6/2008 | Elliot | |
| 2008/0150218 | A1 | 6/2008 | Clark et al. | |
| 2008/0258382 | A1 | 10/2008 | deJong et al. | |
| 2008/0260445 | A1 * | 10/2008 | Costanza et al. | 399/394 |

FOREIGN PATENT DOCUMENTS

EP 1054302 A2 11/2000

OTHER PUBLICATIONS

Atwood, et al., "Velocity Matching Calibration Method for Multiple Independently Driven Sheet Transport Devices", U.S. Appl. No. 12/361,751, filed Jan. 29, 2009.
http://www.algebralab.org/lessons/lessons.aspx?file=Trigonometry_TrigAngLinVelocity.xml. 2003-2009.
http://wikipedia.org/wiki/Servomechanism, 2009.

* cited by examiner

*Primary Examiner* — Kaitlin S Joerger
(74) *Attorney, Agent, or Firm* — Hoffmann & Baron, LLP

(57) ABSTRACT

A processing device to provide hybrid control of sheet transport modules. The processing device includes a first sheet transport module, a second sheet transport module and a control subsystem. The first sheet transport module and the second sheet transport module are configured to transport a sheet. The control subsystem is configured to set velocity of the first sheet transport module before a transfer of the sheet from the first sheet transport module to the second sheet transport module. The control subsystem is further configured to set torque of the first sheet transport module to a torque value to control tension of the sheet to a first sheet tension value when the sheet transfers from the first sheet transport module to the second sheet transport module.

20 Claims, 4 Drawing Sheets

HYBRID CONTROL OF SHEET TRANSPORT MODULES

TECHNICAL FIELD

The present application relates generally to electrophotographic printing technology. More specifically, the present application is directed to hybrid control of sheet transport modules in a processing device, such as an electrophotographic printing device.

BACKGROUND

Electrophotographic print architectures are used in processing devices such as copy machines and laser printers. Generally, a laser generates a positively charged negative image on a photoconductive drum. A negatively charged toner is attracted to the positively charged negative image on the photoconductive drum. The toner from the negative image on the drum is attracted to a positively charged sheet of paper as the sheet is advanced by the photoconductive drum, generating a positive image on the sheet. The toner is then fused to the sheet using pressure, a combination of heat and pressure, or light, causing the toner in the positive image to permanently adhere to the sheet.

Devices employing various electrophotographic print architectures have been developed. Some devices utilize modular electrophotographic print architectures, which may include multiple sheet transport modules to print, fuse, or otherwise process one or more sheets of paper as they are advanced through the transport modules. The sheet transport modules may include one or more print modules, one or more pre-processing modules, and one or more post-processing modules. For example, certain monochrome print architectures may include one print module to deposit a single color toner (e.g., black) as a sheet of paper is transported. The pre-processing and post-processing transport modules may perform sheet inversion, sheet decurling, sheet charge neutralization, sheet registration, sensing sheet properties or sensing printed images on a sheet. Certain color devices may include multiple print modules with each print module depositing a different color toner and a fuser module fusing the color toners to the sheet. Thus, various sheet transport modules may exist in different electrophotographic print architectures.

Certain modular electrophotographic print architectures include sheet transport modules that utilize electrostatic escort belts to transport sheets of paper through the sheet transport modules. In such modular electrophotographic print architectures, a first sheet transport module electrostatically tacks an incoming sheet of paper to its escort belt and transports it through the first sheet transport module. As the sheet of paper exits the first sheet transport module, a second sheet transport module tacks the sheet of paper to its escort belt and transports it through the second sheet transport module. Although it is desired that the escort belts operate at the same surface velocity, the surface velocity of the escort belts may vary due to differences in mechanical tolerances and imperfections in the escort belt structure of each sheet transport module. For example, the imperfections may include escort belt thickness variations, drive roll and tension roll diameter variations, conicity, wobble, run-out, drive-train vibrations, torque ripple, as well as other imperfections. The surface velocity differences are also pervasive in other modular electrophotographic print architectures regardless of transport technology employed in the sheet transport modules.

Notwithstanding the transport technology employed in the modular electrophotographic print architectures, when a sheet of paper is transported by several sheet transport modules simultaneously—such as during transfer of sheets between the sheet transport modules—large pulling forces or buckling forces may accumulate in the sheet. These forces are undesirable as they may cause the sheet to tear, buckle or slip in the sheet transport modules. These forces may also cause vibration, such as during transfer of sheets between the sheet transport modules, which negatively affects image quality such as color-to-color registration in color devices, as well as smearing and banding in color and monochrome devices.

SUMMARY

In accordance with embodiment, a processing device is disclosed. The processing device includes a first sheet transport module, a second sheet transport module and a control subsystem. The first sheet transport module is configured to transport a sheet. The second sheet transport module is configured to transport the sheet. The control subsystem is configured to set velocity of the first sheet transport module before a transfer of the sheet from the first sheet transport module to the second sheet transport module. The control subsystem is further configured to set torque of the first sheet transport module to a torque value to control tension of the sheet to a first sheet tension value when the sheet transfers from the first sheet transport module to the second sheet transport module.

In accordance with another embodiment, a processing device is disclosed. The processing device includes a first sheet transport module, a second sheet transport module and a control subsystem. The first sheet transport module includes an escort belt, a pair of rollers and at least one senor. The escort belt is configured to transport a sheet. The pair of rollers is configured to guide the escort belt. The at least one sensor is configured to detect the sheet in relation to the first sheet transport module. The second sheet transport module is configured to transport the sheet. The control subsystem is configured to set surface velocity of the escort belt to a velocity value before a transfer of the sheet from the first sheet transport module to the second sheet transport module. The control subsystem is also configured to determine based on the detection by the at least one senor that the sheet is transferring from the first sheet transport module to the second sheet transport module. The control subsystem is further configured to set torque of a first roller of the pair of rollers to a torque value to control tension of the sheet to a first sheet tension value based on the determination that the sheet is transferring.

BRIEF DESCRIPTION OF THE DRAWINGS

Some embodiments are shown by way of example and not limitation in the figures of the accompanying drawings in which.

DETAILED DESCRIPTION

Hybrid control of sheet transport modules in a processing device (e.g., an electrophotographic printing device) is disclosed herein. In the following description, for the purposes of explanation, numerous specific details are set forth in order to provide a thorough understanding of example embodiments. It will be evident, however, to one skilled in the art, that an example embodiment may be practiced without all of the disclosed specific details.

As used herein a "processing device" refers to a copy machine, a laser printer or any other device employing an electrophotographic print architecture that includes one or more sheet transport modules.

As used herein a "sheet transport module" refers to a component of the processing device that includes multiple elements configured to print, fuse, or otherwise process one or more sheets of paper as they are advanced through the component.

As used herein a "transport control subsystem" refers to an electronic subsystem of the processing device configured to provide hybrid velocity/torque control of the sheet transport modules of the modular electrophotographic print architecture in the processing device.

Figure 1:
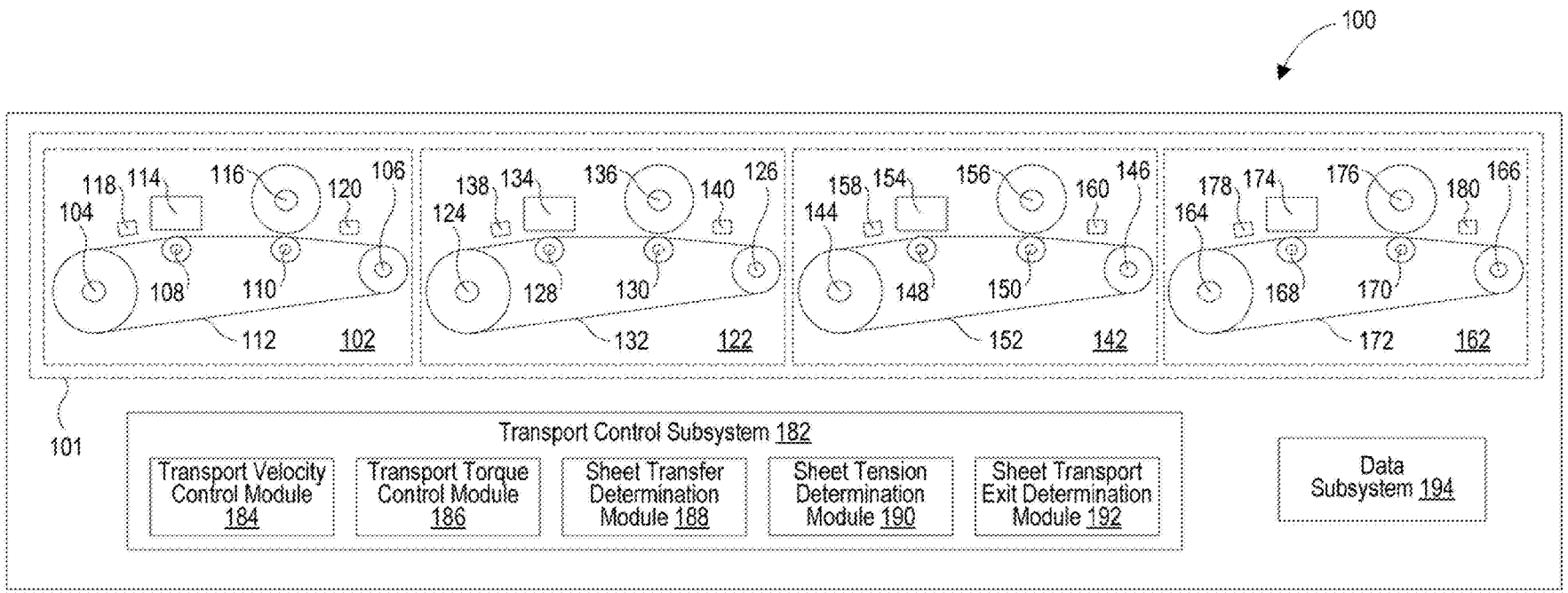
FIG. 1 is a schematic of an example printing device of a modular electrophotographic print architecture that includes multiple sheet transport modules.

FIG. 1 is a schematic of an example printing device 100 having a modular electrophotographic print architecture 101. The modular print architecture 101 includes a plurality of sheet transport modules 102, 122, 142 and 162, a transport control subsystem 182 and a data control subsystem 194.

As shown in FIG. 1, the modular electrophotographic print architecture 101 of the example printing device 100 includes four example sheet transport modules 102, 122, 142 and 162 that deposit different color toner to facilitate a four-color printing model (e.g., cyan, magenta, yellow and key (black)—"CMYK"). In other embodiments, color models that require different numbers of sheet transport modules may be used (e.g., hexachrome color model using subtractive color mixing of six colors). Pre-processing and post-processing modules may also be provided. For example, a post-processing module may be provided to fuse the toner from the sheet transport modules 102, 122, 142 and 162. Other sheet transport modules not enumerated herein may also used in the modular electrophotographic print architecture 101. The number of transport modules in the modular electrophotographic print architecture 101 is not limited and may include a greater or fewer number of sheet transport modules. For example, eight-color printing may be provided via eight sheet transport modules for the eight different color toners. In addition, the sheet transport modules of modular electrophotographic print architecture 101 may be similar to or different from one another.

The first transport module 102 includes a pair of rollers 104, 106, a pair of backing rollers 108, 110, an escort belt 112, a tacking device 114, a marking device 116, and at least one sensor 118, 120.

The rollers 104, 106, 108, 110 are configured to support and guide the escort belt 112. Roller 104 is configured as a free roller, while roller 106 is configured as a drive roller that drives the escort belt 112 (e.g., via one or more of a motor, a cam, a shaft, and/or any other device configured to drive the drive roller 106). In certain embodiments, the function of the rollers 104, 106 may be reversed. The drive roller 106 can be driven by various electro mechanical motors, either directly or via gears and/or timing belts. Backing rollers 108, 110 are configured to provide support for the escort belt 112.

The escort belt 112 is configured to transport sheets of paper through the transport module 102. The escort belt 112 may be an electrostatic escort belt. In an alternate embodiment, the escort belt may be a vacuum escort belt. Other escort belts that facilitate transporting the sheets of paper though the transport module 102 may be used.

The tacking device 114 is configured to removeably adhere sheets of paper to the escort belt 112 for transport of the sheets through the transport module 102. Different technologies may be implemented to removeably adhere the sheets to the escort belt 112. For example, tacking device 114 may be a corotron device, a packing roller, or any other device configured to removeably adhere sheets of paper to the escort belt 112 to transport the sheets through the sheet transport module 102. The tacking device 114 may be omitted if the escort belt 112 is a vacuum escort belt. Instead of the tacking device 114, a vacuum generation device (not shown) may be used to provide a differential in air pressure between a vacuum chamber on a first side of the vacuum escort belt (which is perforated) and the ambient atmospheric pressure on the opposite second side of the vacuum escort belt to removeably adhere sheets of paper to the vacuum escort belt.

The marking device 116 is configured to mark (e.g., print or image) the sheets of paper as they are transported by escort belt 112 through the transport module 102. For example, the marking device 116 may be an imaging drum, a xerographic drum, an intermediate image carrying drum or belt, a solid ink drum, an offset print drum, an inkjet print head, a thermal print head, a direct thermal print head, a sublimation print head, or any other marking device configured to mark the sheets of paper as they are transported by escort belt 112 through the transport module 102.

The at least one sensor 118, 120 is configured to sense or detect a sheet of paper as it is received by the sheet transport module 102, as the sheet transfers to a downstream sheet transport module (e.g., sheet transport module 122) and as the sheet exits the sheet transport module 102. In one embodiment, a single sensor 118 may be used to detect the receipt, the transfer and the exit of a sheet using calculations based on distance that the sheet covers in relation to sensor 118. More specifically, sheet length, sheet transport module dimension, sensor location and the velocity of the sheet may be used for these calculations. In another embodiment, sensor 118 is configured to detect a sheet of paper as it is received by the sheet transport module 102 and as the sheet transfers to a downstream module (e.g., sheet transport module 122), while sensor 120 is configured to detect as the sheet exits sheet transport module 102. Alternately, sensor 120 may be configured to detect as the sheet transfers to a downstream module (e.g., sheet transport module 122) and as the sheet exits sheet transport module 102 using calculations based on distance that the sheet covers in relation to sensor 120.

In some embodiments, a single sensor 118 of sheet transport module 102 may be used across the entire modular print architecture 101 to detect the receipt, the transfer and the exit of a sheet in relation to sheet transport modules 102, 122, 142, 162. Positions of the sheet are obtained based on the sheet's lead edge and trail edge crossings of sensor 118 and measured velocities of sheet transport modules 102, 122, 142, 162 as the sheet is transported. Although this provides less accuracy than at least one sensor in each sheet transport module, it nonetheless offers cost reduction and sufficient accuracy for certain applications.

In certain other embodiments, the receipt, transfer and exit of a sheet in relation to sheet transport modules 102, 122, 142, 162 may be determined on a time-based schedule without any sensor(s). Although this provides less accuracy than using sensors, it nonetheless offers cost reduction and sufficient accuracy for certain applications.

Sheet transport modules 122, 142, and 162 may be similar to or different than sheet transport module 102. For example, sheet transport module 122 may be an electrostatic sheet transport module, sheet transport module 142 may be a vacuum sheet transport module and sheet transport module 162 may be an imaging drum and opposing nip.

In some embodiments, the rollers 124, 126, 128, 130 of sheet transport module 122, the rollers 144, 146, 148, 150 of sheet transport module 142, and the rollers 164, 166, 168, 170 of sheet transport module 162, may be similar to (or different than) the rollers 104, 106, 108, 110 of sheet transport module 102 that were described in detail hereinabove.

The tacking devices 134, 154 and 174 of respective sheet transport modules 122, 142 and 162, may be similar to (or different than) the tacking device 114 of sheet transport module 102 that was described in detail hereinabove. In some embodiments, where the escort belt 132, 152 or 172 is vacuum escort belt, the tacking device 134, 154 or 174 may be omitted and a vacuum generation device (not shown) may be provided to generate a differential in air pressure to removeably adhere sheets of paper to the vacuum escort belt.

The marking devices 136, 156, 176 of respective sheet transport modules 122, 142 and 162, may be similar to or different than the marking device 116 of sheet transport module 102 that was described in detail hereinabove. The marking devices 136, 156, 176 may include an imaging drum, a xerographic drum, a solid ink drum, an offset print drum, an inkjet print head a thermal print head, a direct thermal print head, a sublimation print head, or any other marking device configured to mark the sheets of papers as they are transported through the respective sheet transport modules 122, 142, 162.

The at least one sensor 138, 140 of sheet transport module 122, the at least one sensor 158, 160 of sheet transport module 142 or the at least one sensor 178, 180 of sheet transport module 162 may be similar to or different than the at least one sensor 118, 120 of sheet transport module 102 that was described in detail hereinabove. The at least one sensor of a respective sheet transport module is configured to sense or detect a sheet as it is received by the sheet transport module, as the sheet transfers to a downstream sheet transport module, and as the sheet exits the sheet transport module. A variety of different configurations may be employed as described hereinabove. Also as described hereinabove, a time-based schedule may be used instead of sensors.

Now with further reference to the example printing device 100, the transport control subsystem 182 of example the printing device 100 is configured to provide hybrid velocity/torque control of the sheet transport modules 102, 122, 142, 162 in the modular electrophotographic print architecture 101. The transport control subsystem 182 includes a transport velocity control module 184, a transport torque control module 186, a sheet transfer determination module 188, a sheet tension determination module 190 and a sheet transport exit determination module 192.

The transport velocity control module 184 is configured to receive a control signal indicating a print job and in response to the control signal to control the surface velocity of the escort belts 112, 132, 152 and 172 in the respective sheet transport modules 102, 122, 142 and 162, e.g., setting the velocity of the escort belts 112, 132, 152 and 172 to a predetermined velocity value. For example, the velocity value may be set to from about 0.2 m/s to about 1.0 m/s velocity. More specifically, the transport velocity control module 184 is configured to control the surface velocity of the escort belts 112, 132, 152 and 172 in the respective sheet transport modules 102, 122, 142 and 162 from when a sheet transport module is empty and until a sheet of paper begins to transfer to a downstream sheet transfer module (e.g., transfer of a sheet from sheet transport module 102 to sheet transport module 122). The transport velocity control module 184 may also be used to control velocity during calibration and warm-up of the modular electrophotographic print architecture 101.

The transport torque control module 186 is configured to control the torque of the drive rollers 106, 126, 146 and 166 of the respective escort belts 112, 132, 152 and 172 in the sheet transport modules 102, 122, 142 and 162 in order to maintain desired sheet tension when a sheet of paper transfers between sheet transport modules and when the sheet exits a sheet transport module, e.g., setting the torque of the drive rollers 106, 126, 146 and 166 to a desired torque value to control sheet tension to a desired tension value. Sheet tension may be determined by the sheet tension determination module 190, as will be described in greater detail below. For example, when a sheet transfers, the torque value may be set to about 0.334 Nm in order to control tension to a 2 N tension value. As another example, when a sheet exits, the torque value may be set to about 0.0083 Nm in order to control tension to a 0.5 N tension value.

The sheet transfer determination module 188 is configured to determine when a sheet of paper transfers from a first sheet transport module to a second downstream sheet transport module, e.g., sheet transferring from sheet transport module 102 to sheet transport module 122. The sheet transfer determination module 188 may make a determination of whether a sheet is transferring based on the at least one sensor of a sheet transport module. For example, the sheet transfer determination module 188 may determine that a sheet is transferring from sheet transport module 102 to sheet transport module 122 based on detection by the at least one sensor 118, 120 of sheet transport module 102, as described in greater detail hereinabove.

The sheet tension determination module 190 is configured to determine the sheet tension of a sheet in a sheet transport module. For example, sheet tension determination module 190 may determine the sheet tension of the sheet in the sheet transport module 102. The determined sheet tension may be used by the transport torque control module 186 to adjust a torque value in order to control the sheet tension to desired tension value. For example, the transport torque control module 186 may set the torque of drive roller 106 to a desired torque value in order to control sheet tension to a desired tension value, when a sheet transfers between sheet transport module 102 and sheet transport module 122. The desired tension value can be varied as the sheet is being transferred. For example, it can be set low during an initial part of the sheet transfer, then higher in an intermediate part of the sheet transfer, and finally set low during a final part of the sheet transfer.

The sheet transport exit determination module 192 is configured to determine when a sheet exits a sheet transport module. The sheet transport exit determination module 192 may make a determination of whether a sheet has exited based on the at least one sensor of a sheet transport module. For example, sheet transport exit determination module 192 may determine that a sheet has exited from sheet transport module 102 based on detection by the at least one sensor 118, 120 of sheet transport module 102.

The data subsystem 194 is configured to control printing performed by the modular electrophotographic print architecture 101. More specifically, the data subsystem 194 is configured to receive print data to be printed by the marking elements 116, 136, 156 and 176 of the respective sheet transport modules 102, 122, 142 and 162 in the modular electrophotographic print architecture 101 of the example printing device 100. The data subsystem 194 is further configured instruct the marking elements 116, 136, 156 and 176 to print the received print data as sheets of papers are advanced by the respective sheet transport modules 102, 122, 142 and 162. The print data may include data obtained from a scanning device (not shown), a facsimile device (not shown), a client device (not shown), as well as any other device capable of providing print data to be printed by the example printing device 100. The data subsystem 194 may include disparate modules for receiving and printing data.

In operation, the provision of hybrid velocity/torque control of sheet transport modules 102, 122, 142, 162 in the example printing device 100 alleviates the crumpling and buckling forces that may accumulate in the sheets, and mitigates other undesirable characteristics associated with these forces. In such hybrid/velocity control, whenever a sheet transport module is empty it is velocity controlled (e.g., sheet transport module 102 is empty). When a sheet enters a sheet transport module (e.g., sheet transport module 102), the sheet transport module is velocity controlled until the sheet enters a subsequent downstream sheet transport module (e.g., sheet transport module 102 is velocity controlled).

When the sheet enters the next downstream sheet transport module (e.g., sheet transport module 122), the sheet transport module is switched to torque control and the sheet transport module is torque controlled to control sheet tension to a first desired value until the sheet begins to exit the sheet transport module (e.g., sheet transport module 102). Until the sheet completely exits the sheet transport module (e.g., sheet transport module 102), the sheet transport module is torque controlled (gradually reducing torque) to control sheet tension to a second desired value to provide for a smoother transfer between sheet transport modules (e.g., gradually reducing sheet tension to minimize a tension spike as the sheet completely exists). This type of control minimizes velocity spikes and vibrations, reducing color registration errors and other undesirable characteristics associated with these forces. Thereafter, the sheet transport module (e.g., sheet transport module 102) is again velocity controlled. The switching between velocity and torque control is performed using bumpless transfer implementations in order to minimize any velocity and torque spikes when the control is switched.

Figure 2:
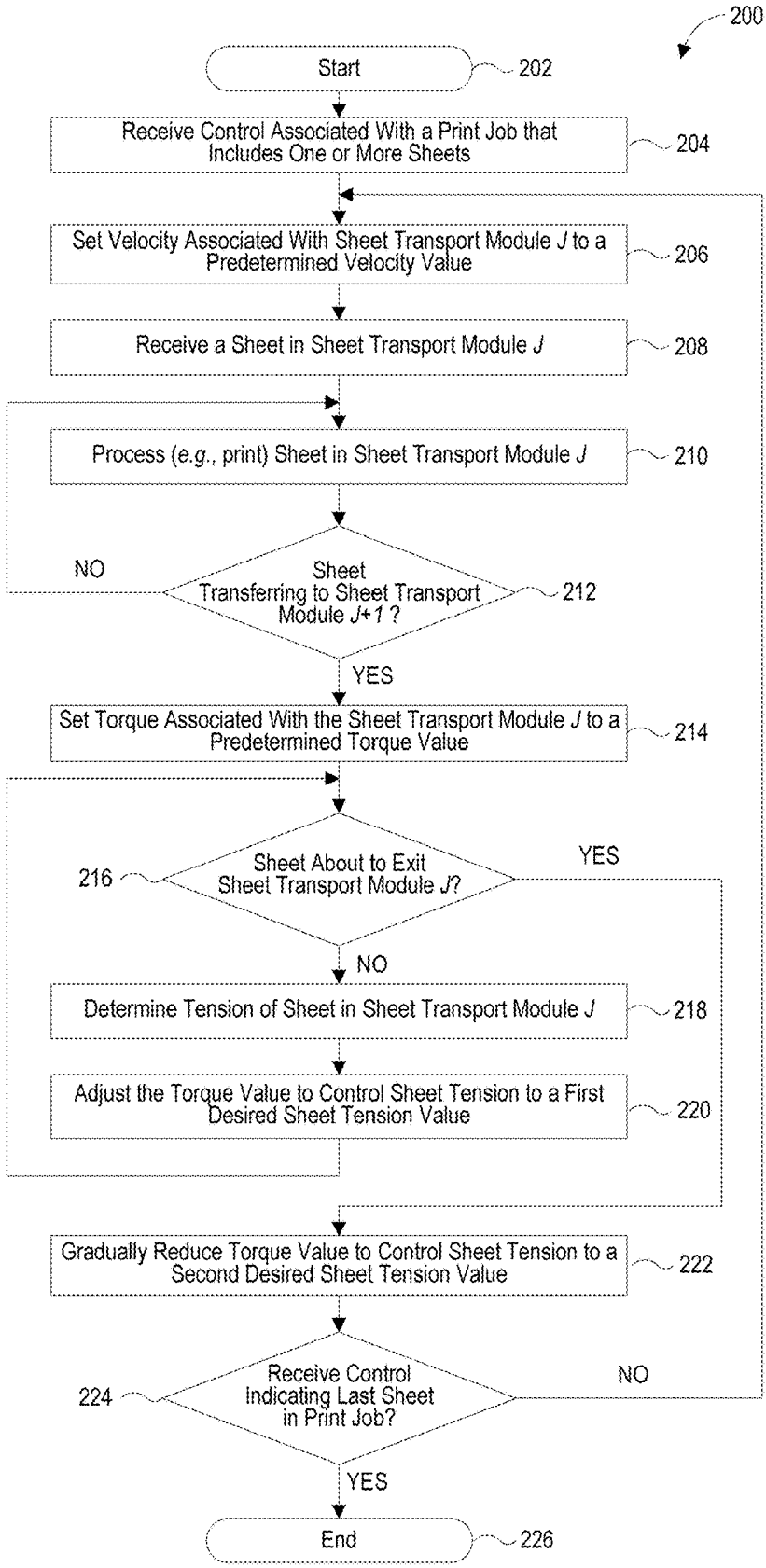
FIG. 2 is a flowchart of an example method of providing hybrid control of sheet transport modules in an electrophotographic printing device in accordance with FIG. 1.

FIG. 2 is a flowchart of an example method 200 of providing hybrid control of a sheet transport module in printing device 100 in accordance with FIG. 1. The method 200 of FIG. 2 may be employed in connection with any one or more the sheet transport module 102, 122, 142 and 162 of the printing device 100, as well as with any additional sheet transport modules that may be included in printing device 100.

The method 200 starts at operation 202. At operation 204, a control (e.g., control indictor) associated with a print job of one or more sheets is received. For example, the transport velocity control module 184 may receive the control indicator that indicates that a print job was received by the printing device 100, has been processed and is now ready for printing. At operation 206, the velocity associated with sheet transport module J (e.g., sheet transport module 102) is set to a predetermined velocity value. For example, the transport velocity control module 184 sets the surface velocity of the escort belt 112 of sheet transport module 102 to a predetermined velocity value. The velocity value is typically between about 0.2 m/s and about 1.0 m/s. The escort belt 112 is driven by the drive roller 106 and an angular velocity that corresponds to the belt surface velocity is used to set motor velocity of the drive roller 106.

At operation 208, the sheet transport module J (e.g., sheet transport module 102) receives a sheet of paper to be processed by the transport module J (e.g., sheet transport module 102). For example, sheet transport module 102 receives a sheet of paper to be printed. The receipt of the sheet may be detected by sensor 118 (e.g., detecting a leading edge of the sheet entering the sheet transport module 102). At operation 210, the received sheet is processed in the transport module J (e.g., sheet transport module 102). More specifically, the sheet may be printed by the marking device 116 of the sheet transport module 102, as the sheet is transported by the escort belt 112 through the sheet transport module 102. The printing of the sheet may be controlled by the data subsystem 194. The processing may include pre-processing, post processing, printing and other processing functions such as de-curling, over-coating, drying, transporting a sheet with additional motion quality constraints past image sensors, as well as other processing functions.

At operation 212, a determination is made as to whether the sheet is transferring from the sheet transport module J to a subsequent downstream sheet transport module J+1 (e.g., sheet transferring from the sheet transport module 102 to the sheet transport module 122). For example, the sheet transfer determination module 188 may determine whether the sheet is sheet transferring from the sheet transport module 102 to the sheet transport module 122. The transfer determination of the sheet determined by the sheet transfer determination module 188 may be based on the prior detection by a sensor 118 (e.g., such as by determining the distance that the sheet has traveled after detection by sensor 118) or based on the receipt of the sheet in sheet transport module 122 based on detection by sensor 138 of the sheet transport module 122 (e.g., detecting the sheet entering the sheet transport module 122).

If it is determined that the sheet is not transferring at operation 212, the method 200 continues at operation 210, where processing (e.g., printing) of the sheet continues. It is noted that the sheet transport module J (e.g., sheet transport module 102) remains in velocity control set to the predetermined velocity value. Alternatively, if it is determined that the sheet is transferring at operation 212, the method 200 continues at operation 214, where the torque of print module J (e.g., sheet transport module 102) is set to a predetermined torque value. For example, the transport torque control module 186 sets the torque of the drive roller 106 in sheet transport module 102 to a predetermined torque value from about 0.01 Nm to about 2.0 Nm.

At operation 216, a determination is made as to whether the sheet is about to exit from the sheet transport module J (e.g., sheet exiting from the sheet transport module 102). For example, the sheet transport exit determination module 192 may determine whether the sheet is about to exit from the sheet transport module 102. The exit determination of the sheet determined by the sheet transport exit determination module 192 may be based on detection by sensor 120 (e.g., detecting the sheet is about to exit the sheet transport module 102).

If it is determined that the sheet is not about to exit at operation 216, the method 200 continues at operation 218, where the tension of the sheet in the print module J (e.g., sheet transport module 102) is determined. For example, sheet tension determination module 190 may determine the sheet tension of the sheet in the sheet transport module 202. At operation 220, the torque associated with sheet transport module J is adjusted based on the determined tension of the sheet to control the tension of the sheet to a first desired sheet tension value. Thereafter, the method continues at operation 216. Print module J (e.g., sheet transport module 102) is thus torque controlled so that the tension of the sheet is of the first desired sheet tension value.

If it is determined that the sheet is about to exit at operation 216, the method 200 continues at operation 222, where the torque of the print module J (e.g., sheet transport module 102) is gradually reduced to control sheet tension to a second desired value for module exit, mitigating spikes in tension of the sheet. Thereafter, the method 200 continues at operation 224, where a determination is made as to whether a control (e.g., control indicator) indicating a last sheet of the print job is received. For example, the transport toque control module 186 may receive the control indicator that indicates the last sheet of the print job.

If it is determined it is not the last sheet of the print job at operation 224, the method 200 continues at operation 206, where the velocity associated with sheet transport module J (e.g., sheet transport module 102) is set to the predetermined velocity value. Alternatively, if it is determined it is the last sheet of the print job at operation 224, the method 200 ends at operation 226.

Figure 3:
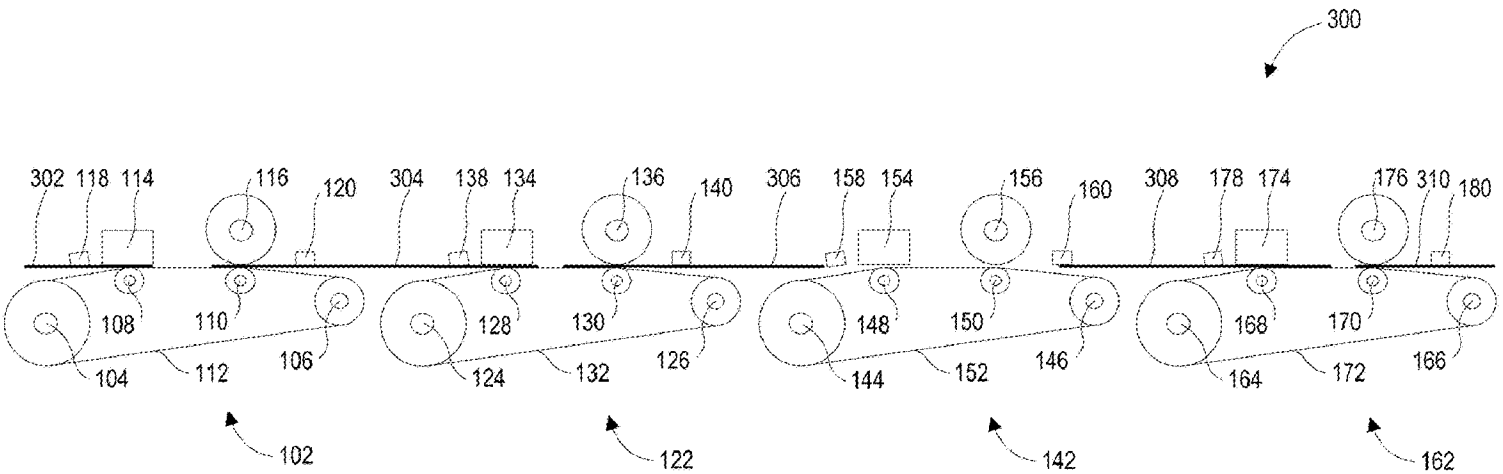
FIG. 3 is an example of providing hybrid control of sheet transport modules of the example printing device of FIG. 1.

FIG. 3 is an example view 300 of hybrid velocity/torque control of sheet transport modules 102, 122, 142, 162 in the example printing device 100 of FIG. 1. As shown in the example view 300 of FIG. 3, sheet transport module 102 is receiving a sheet 302 based on detection, such as for example, by sensor 118. Sheet transport module 102 is also transferring a sheet 304 to sheet transport module 122 based on detection, such as for example, by sensor 118, 120 or 138. Because, sheet transport module 102 is transferring sheet 304, sheet transport module 102 is torque controlled by the transport torque control module 186. More specifically, the torque associated with the drive roller 106 of sheet transport module 102 is set to a first predetermined torque value. (e.g., between about 0.1 Nm and about 2.0 Nm). The torque value is achieved by appropriate control of a drive roller, e.g., drive roller 106 of sheet transport module 102.

Thereafter, the torque value is adjusted to control sheet tension of sheet 304 to a desired tension value until the sheet 304 begins to exit the sheet transport module 102. The desired tension may be from about 0.5 N to about 20 N depending on particular design requirements of the example printing device 100. After sheet 304 exits the sheet transport module 102, the sheet transport module 102 is velocity controlled by the transport velocity control module 184 if there are additional sheets to be processed or is torque controlled until full stop if there are no additional sheets to be processed (e.g., end of print job).

Similarly, sheet transport module 122 is receiving sheet 304 based on detection, such as for example, by sensor 138. However, sheet transport module 102 has not yet begun to transfer sheet 306 to sheet transport module 142. More specifically, the transfer has not yet been detected based on detection of sensor 138, 140, or 158. Because, sheet transport module 122 is not yet transferring sheet 306, sheet transport module 122 is velocity controlled. More specifically, the surface velocity of the escort belt 132 is set to a predetermined velocity value (e.g., between about 0.2 m/s and about 1.0 m/s). The velocity is achieved by appropriate control a drive roller, e.g., drive roller 126 of sheet transport module 122, until the sensed velocity desired is reached.

As is further shown in the example view 300 of FIG. 3, sheet transport module 142 has not yet begun to receive sheet 306 from sheet transport module 122, based on detection, such as for example, by sensor 158. However, sheet transport module 142 is transferring a sheet 308 to sheet transport module 162 based on detection, such as for example, by sensor 158, 160 or 178. As further shown in view 300 of FIG. 3, sheet 308 is also exiting sheet transport module 142. Because, sheet transport module 142 is transferring sheet 308, sheet transport module 142 is torque controlled. More specifically, before the sheet 308 began to exit sheet transport module 142, the torque value associated with the drive roller 146 of sheet transport module 142 has been set and adjusted to control sheet tension of sheet 308 to a first desired tension value.

After the sheet begins to exit sheet transport module 142, the torque value associated with the drive roller 146 of sheet transport module 142 is gradually reduced to control sheet tension to a desired second tension value until the sheet 308 exits the sheet transport module 142. This gradual reduction provides for a smoother transfer of sheet 308 from sheet transport module 142 to sheet transport module 162. More specifically, when the sheet 308 looses contact with sheet transport module 142, the tension in sheet 308 resulting from a puling force by escort belt 152 of module 142 instantaneously disappears. Because the tension of the sheet 308 is gradually reduced from the first desired tension to the second desired tension towards the end of the transfer, the pulling force that disappears is smaller than would otherwise be the case with either velocity control or torque control of sheet module 142 as described above. The desired tension may be 20% to about 50% of the first desired tension value described above in relation transfer between sheet transport modules. For example, the desired tension may be from about 0.5 N to about 20 N depending on particular design requirements of the example printing device 100. After sheet 308 exits the sheet transport module 102, the sheet transport module 142 is velocity controlled when there are additional sheets to be processed or torque controlled until full stop when there are no additional sheets to be processed.

Similarly, sheet transport module 162 is receiving sheet 308 based on detection, such as for example, by sensor 178. In the example view 300 of FIG. 3, sheet transport module 162 does not transfer sheet 310 to any additional downstream module. Therefore, sheet transport module 162 is velocity controlled. More specifically, the surface velocity of the escort belt 172 is set to the predetermined velocity value. However, if sheet transport module 162 transfers the sheet 310 to a downstream transport module (not shown) (e.g., fuser transport module or another post-processing module), then based on the detection of sensor 178, 180 or a sensor associated with the downstream transport module, the sheet transport module 162 may be torque controlled during transfer of the sheet to the downstream transport module and during exit of the sheet 310 from the sheet transport module 162.

Thus, as has been shown in the example in the example view 300 of FIG. 3, sheet transport modules 102 and 142 are torque controlled and sheet transport modules 122 and 162 are velocity controlled. Also, as shown in and described with reference to the example view 300 of FIG. 3, sheet transport module 142 gradually reduces the torque (and associated tension) to affect bumpless transfer of sheet 308.

Figure 4:
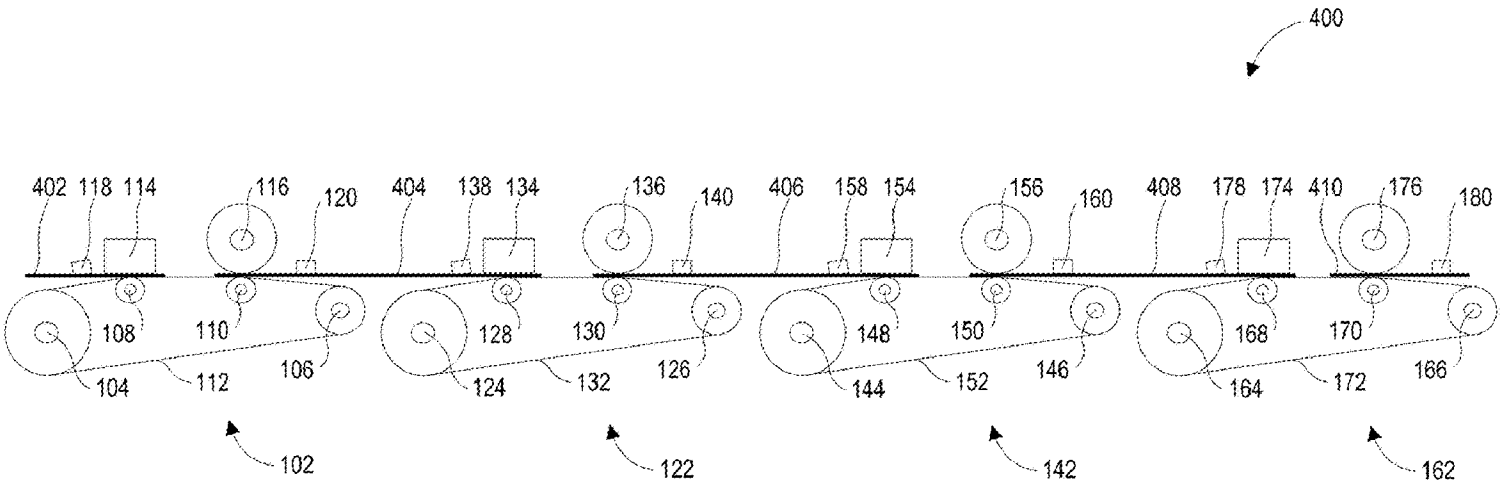
FIG. 4 is another example of providing hybrid control of sheet transport modules of the example printing device of FIG. 1.

FIG. 4 is another example view 400 of hybrid velocity/torque control of sheet transport modules 102, 122, 142, 162 in the example printing device 100 of FIG. 1. As shown in the example view 400 of FIG. 4, sheet transport module 102 is receiving a sheet 402 based on detection, such as for example, by sensor 118. Sheet transport module 102 is also transferring a sheet 404 to sheet transport module 122 based on detection, such as for example, by sensor 118, 120 or 138. Because, sheet transport module 102 is transferring sheet 404, sheet transport module 102 is torque controlled by the transport torque control module 186. More specifically, the torque associated with the drive roller 106 of sheet transport module 102 is set to a predetermined torque value. The torque value is adjusted to control sheet tension of sheet 404 to a desired tension value until the sheet 404 begins to exit the sheet transport module 102.

Similarly, sheet transport module 122 is receiving sheet 404 based on detection, such as for example, by sensor 138. Sheet transport module 102 is also transferring sheet 406 to sheet transport module 142. Because, sheet transport module 102 is transferring sheet 406, sheet transport module 122 is torque controlled by the transport torque control module 186. More specifically, the torque associated with the drive roller 126 of sheet transport module 122 is set to a predetermined torque value. The torque value is adjusted to control sheet tension of sheet 406 to a desired tension value until the sheet 406 begins to exit the sheet transport module 122.

As is further shown in the example view 400 of FIG. 4, sheet transport module 142 is receiving sheet 406 from sheet transport module 122, based on detection, such as for example, by sensor 158. Also, sheet transport module 142 is transferring a sheet 408 to sheet transport module 162 based on detection, such as for example, by sensor 158, 160 or 178. Because, sheet transport module 142 is transferring sheet 408, sheet transport module 142 is torque controlled. More specifically, the torque associated with the drive roller 146 of sheet transport module 142 is set to a predetermined torque value. The torque value is adjusted to control sheet tension of sheet 408 to a desired tension value until the sheet 408 begins to exit the sheet transport module 142.

Sheet transport module 162 is receiving sheet 408 based on detection, such as for example, by sensor 178. In the example view 400 of FIG. 4, sheet transport module 162 does not transfer sheet 410 to any additional downstream module. Therefore, sheet transport module 162 is velocity controlled. More specifically, the surface velocity of the escort belt 172 is set to the predetermined velocity value. However, if sheet transport module 162 transfers the sheet 410 to a downstream transport module (not shown) (e.g., fuser transport module or another post-processing module), then based on the detection of sensor 178, 180 or a sensor associated with the downstream transport module, the sheet transport module 162 may be torque controlled during transfer of the sheet to the downstream transport module and during exit of the sheet 310 from the sheet transport module 162.

Thus, as has been shown in the example view 400 of FIG. 4, sheet transport modules 102, 122 and 142 are torque controlled, while the last downstream sheet transport module 162 is velocity controlled.

Figure 5:
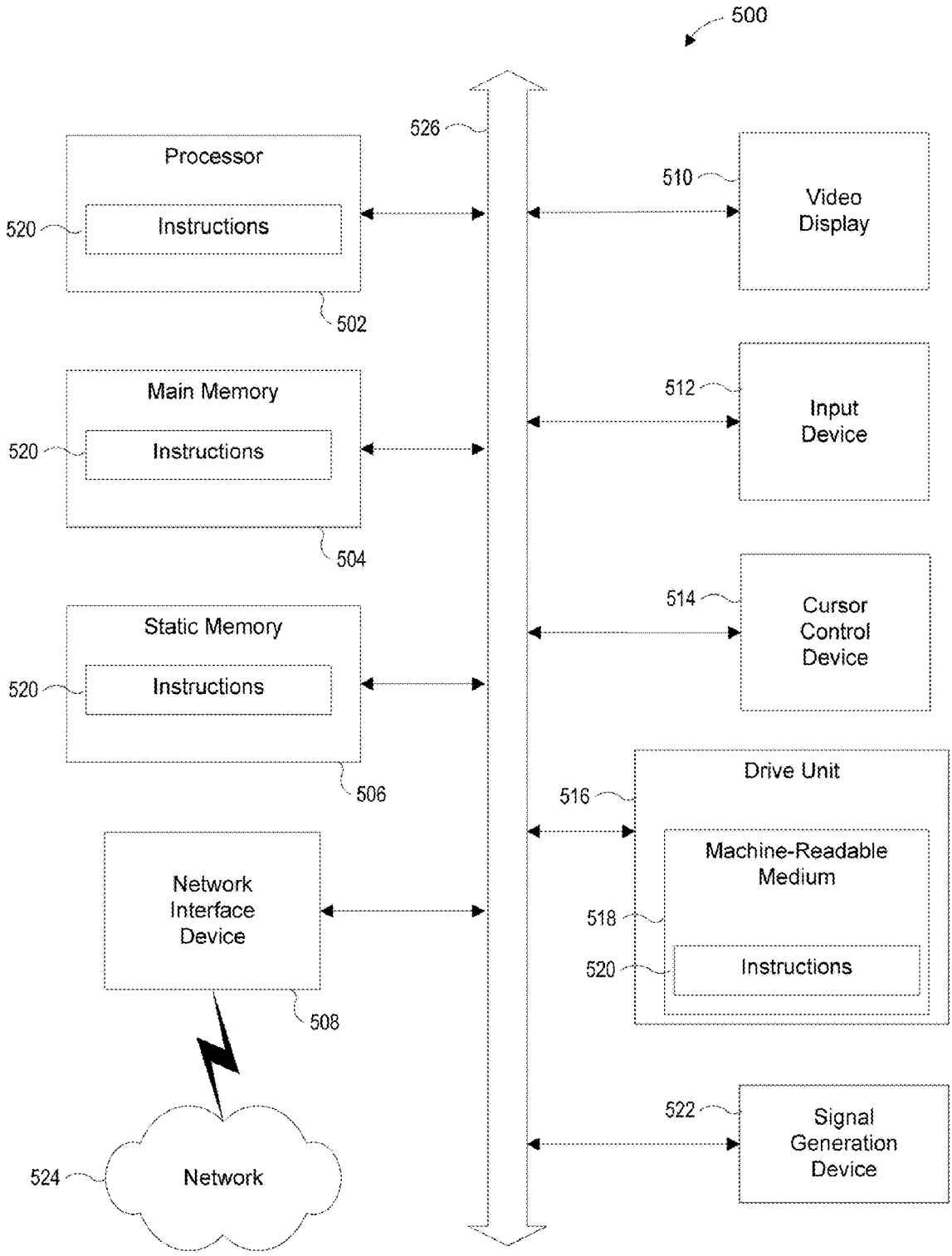
FIG. 5 is a block diagram of a general computer system that can perform any computer based functions or methods disclosed herein.

FIG. 5 is a block diagram of a general computer system 500. The computer system 500 may include a set of instructions that may be executed to cause the computer system 500 to perform any one or more of the computer based functions or methods disclosed herein. The computer system 500, or any portion thereof, may operate as a standalone device or may be connected, e.g., using a network, to other computer systems or peripheral devices.

In a networked deployment, the computer system 500 may operate in the capacity of printing device. The computer system 500 may also be implemented as or incorporated into various devices, such as a personal computer (PC), a tablet PC, a personal digital assistant (PDA), a mobile device, a palmtop computer, a laptop computer, a desktop computer, a communications device, a control system, a scanner, a facsimile machine, a printer, a personal trusted device, a web appliance, or any other machine capable of executing a set of instructions (sequential or otherwise) that specify actions to be taken by that machine. Further, while a single computer system 500 is shown, the term "system" shall also be taken to include any collection of systems or sub-systems that individually or jointly execute a set, or multiple sets, of instructions to perform one or more computer functions.

As shown in FIG. 5, the computer system 500 may include a processor 502, e.g., a central processing unit (CPU), a graphics-processing unit (GPU), or both. Moreover, the computer system 500 may include a main memory 504 and a static memory 506 that may communicate with each other via a bus 526. As shown, the computer system 500 may further include a video display unit 510, such as a liquid crystal display (LCD), an organic light emitting diode (OLED), a projection unit, a television, a flat panel display, a solid state display, or a cathode ray tube (CRT). Additionally, the computer system 500 may include an input device 512, such as a keyboard, and a cursor control device 514, such as a mouse. The computer system 500 may also include a disk drive unit 516, a signal generation device 522, such as a speaker or remote control, and a network interface device 508.

In a particular embodiment, as depicted in FIG. 5, the disk drive unit 516 may include a computer-readable medium 518 in which one or more sets of instructions 520, e.g., software, may be embedded. Further, the instructions 520 may embody one or more of the methods or logic as described herein. In a particular embodiment, the instructions 520 may reside completely, or at least partially, within the main memory 504, the static memory 506, and/or within the processor 502 during execution by the computer system 500. The main memory 504 and the processor 502 also may include computer-readable media.

In an alternative embodiment, dedicated hardware implementations, such as application specific integrated circuits, programmable logic arrays and other hardware devices, may be constructed to implement one or more of the methods described herein. Applications that may include the apparatus and systems of various embodiments may broadly include a variety of electronic and computer systems. One or more embodiments described herein may implement functions using two or more specific interconnected hardware modules or devices with related control and data signals that may be communicated between and through the modules, or as portions of an application-specific integrated circuit. Accordingly, the present system encompasses software, firmware, and hardware implementations.

In accordance with various embodiments, the methods described herein may be implemented by software programs tangibly embodied in a processor-readable medium and may be executed by a processor. Further, in an exemplary, non-limited embodiment, implementations may include distributed processing, component/object distributed processing, and parallel processing. Alternatively, virtual computer system processing may be constructed to implement one or more of the methods or functionality as described herein.

The present application contemplates a computer-readable medium that includes instructions 520 or receives and executes instructions 520 responsive to a propagated signal, so that a device connected to a network 524 may communicate voice, video or data over the network 524. Further, the instructions 520 may be transmitted or received over the network 524 via the network interface device 508.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium may include a solid-state memory such as a memory card or other package that houses one or more non-volatile read-only memories. Further, the computer-readable medium may be a random access memory or other volatile re-writable memory. Additionally, the computer-readable medium may include a magneto-optical or optical medium, such as a disk or tapes or other storage device to capture carrier wave signals such as a signal communicated over a transmission medium. A digital file attachment to an e-mail or other self-contained information archive or set of archives may be considered a medium that is equivalent to a tangible storage medium. Accordingly, the application is considered to include any one or more of a computer-readable medium and other equivalents and successor media, in which data or instructions may be stored.

Although the present application describes components and functions that may be implemented in particular embodiments with reference to particular standards and protocols, the application is not limited to such standards and protocols. Such standards and protocols are periodically superseded by faster or more efficient equivalents having essentially the same functions. Accordingly, replacement standards and protocols having the same or similar functions as those disclosed herein are considered equivalents thereof.

Thus, hybrid control of sheet transport modules in a processing device (e.g., an electrophotographic printing device) has been described. Although specific example embodiments have been described, it will be evident that various modifications and changes may be made to these embodiments without departing from the broader spirit and scope of the invention. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments shown are described in sufficient detail to enable those skilled in the art to practice the teachings disclosed herein. Other embodiments may be utilized and derived therefrom, such that structural and logical substitutions and changes may be made without departing from the scope of this application. This Detailed Description, therefore, is not to be taken in a limiting sense, and the scope of various embodiments is defined only by the appended claims, along with the full range of equivalents to which such claims are entitled.

Thus, although specific embodiments have been shown and described herein, it should be appreciated that any arrangement calculated to achieve the same purpose may be substituted for the specific embodiments shown. This application is intended to cover any and all adaptations or variations of various embodiments. Combinations of the above embodiments and other embodiments not specifically described herein, will be apparent to those of skill in the art upon reviewing the above description.

The Abstract is provided to comply with 37 C.F.R. §1.72(b) and will allow the reader to quickly ascertain the nature of the technical disclosure of this application. It is submitted with the understanding that it will not be used to interpret or limit the scope or meaning of the claims.

In the foregoing description of the embodiments, various features may be grouped together in a single embodiment for the purpose of streamlining the disclosure of this application. This method of disclosure is not to be interpreted as reflecting that the claimed embodiments have more features than are expressly recited in each claim. Rather, as the following claims reflect, inventive subject matter lies in less than all features of a single disclosed embodiment.

What is claimed is:

1. A processing device comprising:

a first sheet transport module configured to transport a sheet;

a second sheet transport module configured to transport the sheet; and a control subsystem configured to set velocity of the first sheet transport module before a transfer of the sheet from the first sheet transport module to the second sheet transport module, the control subsystem further configured to set torque of the first sheet transport module to a torque value to control tension of the sheet to a first sheet tension value when the sheet transfers from the first sheet transport module to the second sheet transport module.

2. The processing device of claim 1, wherein the control subsystem is configured to receive a control associated with a processing job and further configured to set the velocity of the first sheet transport module to a velocity value in response to the receipt of the control.

3. The processing device of claim 1, further comprising a data subsystem configured to receive print data and print the received print data on the sheet in the first sheet transport module.

4. The processing device of claim 1, wherein at least one of the first sheet transport module and the second sheet transport module is a pre-processing module configured to pre-process the sheet, a printing module configured to print the sheet, or post-processing module configured to post-process the sheet.

5. The processing device of claim 1, wherein the control subsystem is further configured to:

determine whether the sheet begins to exit the first sheet transport module; and gradually reduce the torque value to control the tension of the sheet to a second sheet tension value as the sheet exits the first sheet transport module.

6. The processing device of claim 1, wherein the control subsystem is further configured to:

determine tension of the sheet in the first sheet transport module; and adjust the torque value of the first sheet transport module to control the tension of the sheet to the first sheet tension value while the sheet is transferring from the first sheet transport module to the second sheet transport module.

7. The processing device of claim 1, wherein a time-based schedule is used to determine at least one of receipt, transfer and exit of the sheet in relation to the first sheet transport module.

8. The processing device of claim 1, further comprising at least one sensor configured to detect the sheet in relation to the first sheet transport module.

9. The processing device of claim 8, wherein the at least one sensor is configured to detect at least one of receipt, transfer and exit of the sheet in relation to the first sheet transport module.

10. A processing device comprising:

a first sheet transport module including:

an escort belt configured to transport a sheet;

a pair of rollers configured to guide the escort belt; and at least one sensor configured to detect the sheet in relation to the first sheet transport module;

a second sheet transport module configured to transport the sheet; and a control subsystem configured to set surface velocity of the escort belt to a velocity value before a transfer of the sheet from the first sheet transport module to the second sheet transport module, the control subsystem configured to determine based on the detection by the at least one senor that the sheet is transferring from the first sheet transport module to the second sheet transport module, the control subsystem further configured to set torque of a first roller of the pair of rollers to a torque value to control tension of the sheet to a first sheet tension value based on the determination that the sheet is transferring.

11. The processing device of claim 10, wherein the first sheet transport module comprises a marking device configured to mark the sheet as it is transported by the escort belt.

12. The processing device of claim 11, wherein the marking device comprises one of an imaging drum, a xerographic drum, an intermediate image carrying drum or belt, a solid ink drum, an offset print drum, an inkjet print head, a thermal print head, a direct thermal print head, and a sublimation print head.

13. The processing device of claim 10, wherein the at least one sensor is a single sensor disposed proximately to the escort belt and the first roller of the pair of rollers, the single sensor configured to detect the sheet in relation to the first sheet transport module.

14. The processing device of claim 13, wherein the single sensor is further configured to detect the sheet in relation to the second sheet transport module.

15. The processing device of claim 10, wherein the at least one sensor comprises:

a first sensor disposed proximately to the escort belt and the first roller of the pair of rollers, the first sensor configured to detect receipt and transfer of the sheet in relation to the first sheet transport module; and a second sensor disposed proximately to the escort belt and a second roller of the pair of rollers, the second sensor configured to detect exit of the sheet in relation to the first sheet transport module.

16. The processing device of claim 10, wherein the at least one sensor comprises:

a first sensor disposed proximately to the escort belt and the first roller of the pair of rollers, the first sensor configured to detect receipt of the sheet in relation to the first sheet transport module; and a second sensor disposed proximately to the escort belt and a second roller of the pair of rollers, the second sensor configured to detect transfer and exit of the sheet in relation to the first sheet transport module.

17. The processing device of claim 10, wherein the escort belt is one of an electrostatic belt and a vacuum belt.

18. The processing device of claim 10, wherein the control subsystem is configured to set angular velocity of the first roller of the pair of rollers to a velocity value that corresponds to the surface velocity of the escort belt.

19. The processing device of claim 10, wherein the control subsystem is further configured to:

determine based on the detection by the at least one sensor that the sheet is beginning to exit the first sheet transport module; and gradually reduce the torque of the first roller to control the tension of the sheet to a second sheet tension value as the sheet is exiting the first sheet transport module.

20. The processing device of claim 10, wherein the control subsystem is configured to:

determine tension of the sheet in the first sheet transport module; and adjust the torque value of the first roller to control the tension of the sheet to the first sheet tension value while the sheet is transferring from the first sheet transport module to the second sheet transport module.

* * * * *